US005499433A

United States Patent [19]

Moghaddassi et al.

[11] Patent Number: 5,499,433

[45] Date of Patent: Mar. 19, 1996

[54] APPARATUS FOR SURFACE TREATMENT OF PILE AND PLUSH FABRICS

[75] Inventors: Majid Moghaddassi, Greensboro; Arne Nielsen, Oak Ridge, both of N.C.

[73] Assignee: Guilford Mills, Inc., Greensboro, N.C.

[21] Appl. No.: 170,001

[22] Filed: Dec. 17, 1993

[51] Int. Cl.[6] ..... D06C 11/00; D06C 13/00

[52] U.S. Cl. ..... 26/2 R; 26/15 R; 26/37; 26/52

[58] Field of Search ..... 26/8 C, 10 C, 26/2 R, 15 R, 32, 51, 52, 92, 91, 27–28, 37, 18, 29 R, 93

[56] References Cited

U.S. PATENT DOCUMENTS

| | | | |
|---|---|---|---|
| 1,585,667 | 5/1926 | Haas . | |
| 1,587,528 | 6/1926 | Horstmann . | |
| 1,681,918 | 8/1928 | Horstmann . | |
| 2,360,228 | 10/1944 | Hogue . | |
| 2,482,270 | 9/1949 | Grundy | 26/51 |
| 2,591,861 | 4/1952 | Pannaci | 26/52 |
| 3,130,472 | 4/1964 | Bickford | 26/51 |
| 3,175,245 | 3/1965 | Kreeft et al. | 26/91 |
| 3,195,177 | 7/1965 | Kawamura et al. | 26/91 |
| 3,769,666 | 11/1973 | Kaufman | 26/15 R |
| 3,969,797 | 7/1976 | Riedel et al. | 26/15 R |
| 4,218,810 | 8/1980 | Engels | 26/15 R |
| 5,379,497 | 1/1995 | Nielsen et al. | 26/15 R |

*Primary Examiner*—Amy B. Vanatta
*Attorney, Agent, or Firm*—Shefte, Pinckney & Sawyer

[57] ABSTRACT

An apparatus for shearing, tigering, napping or other surface treatment of a finite length of a textile fabric, particularly pile and plush fabrics, is disclosed which is especially adapted for experimental research and development usage in a laboratory setting. The apparatus includes a rotatably driven roller having a fabric surface-engaging periphery and an arm assembly for supporting the fabric piece for presentation to the roller, the arm assembly being movable between a fabric-loading position spaced from the roller and a treatment position in close adjacency to the roller. The arm assembly has a pair of fabric clamps mounted to respective chain assemblies which can be moved in opposite or the same directions independently or in tandem to facilitate attachment of the opposite ends of the fabric to the respective clamps by movement of the clamps toward one another, fabric tensioning by movement of the clamps away from one another, and fabric travel past the roller by coordinated unitary movement of the clamps in tandem. Guide rollers within the apparatus alternatively enable either a continuous loop of fabric or an indeterminate traveling length of fabric to be processed.

13 Claims, 6 Drawing Sheets

APPARATUS FOR SURFACE TREATMENT OF PILE AND PLUSH FABRICS

BACKGROUND OF THE INVENTION

The present invention relates generally to textile fabric finishing apparatus and, more particularly, to apparatus for the surface treatment of pile and plush fabrics, e.g., fabric shearing and tigering machines.

In the manufacture of pile and other plush-type textile fabrics, it is common to perform various finishing operations to enhance the appearance or hand of the pile or plush surface. For example, shearing machines are often employed to sever the tips of pile loops on a pile fabric to produce a velour-type plush surface effect. Napping and tigering machines may be employed as a subsequent processing step to brush the plush fabric surface to liberate and remove excess loose fibers and thereby improve the surface appearance and feel.

One of the difficulties in performing such finishing operations on pile and plush fabrics in a commercial production setting is that the resultant surface effect on the fabric and the affected fabric characteristics, e.g., surface appearance, hand, drapeability, fabric weight, etc., cannot necessarily be predicted accurately in advance simply by selection of the variable operating parameters and settings of the fabric treating machine. Accordingly, the control and regulation of fabric shearing, tigering and other surface treatment operations on pile and plush fabrics is to at least some extent an art based in part on experience and experimentation. Disadvantageously, in the commercial production of fabric, trial and error experimentation in the set-up of such finishing machines leads to fabric waste and decreased production efficiency and, in turn, once a commercial operation is underway, militates against frequent changes in machine production settings which might otherwise be desirable to accomplish a variety of fabric effects.

SUMMARY OF THE INVENTION

It is accordingly an object of the present invention to provide a novel apparatus for the surface treatment of pile and plush fabrics, which is particularly suitable for preliminary testing and experimentation on sample pieces of fabric, e.g., in a laboratory or research and development setting, as a means of facilitating more efficient and predictable set-up of commercial production machinery, e.g., shearing, napping and tigering machines, so that fabric waste can be minimized and production efficiency can be optimized.

Briefly summarized, the apparatus of the present invention is particularly adapted for the surface treatment of a finite length of pile and plush fabrics and, for such purpose, basically comprises a rotatably driven treating roller having a pile-engaging periphery (e.g., a shear roller, napping roller or tigering roller), and means for supporting the length of fabric for presentation to the roller for surface treatment. The fabric supporting means is movable between a fabric loading position spaced from the treating roller and a treatment position in close adjacency to the roller, and comprises a pair of fabric clamps, means for moving the clamps selectively toward one another for engagement of opposite ends of the length of fabric respectively by the clamps and away from one another for tensioning the length of fabric, and means for moving the clamps in synchronism with one another to cause the length of fabric to travel in tensioned condition for presentation to the roller for surface treatment.

In the preferred embodiment, the fabric supporting means comprises an arm which is pivotably movable between the fabric loading and treatment positions, with a pair of elongate endless chain mechanisms mounted generally coextensively with one another to the arm for selective movement in opposite directions, each of the fabric clamps being affixed to a respective one of the chain mechanisms. A clutch is provided for operatively connecting and disconnecting the chain mechanisms with respect to one another. Preferably, each chain mechanism comprises a pair of essentially identical endless chains connected with one another in spaced parallel facing relation for integral movement.

It is also preferred that a system of rollers or other fabric guides are provided to enable either an endless loop of fabric or an extended indeterminate length of fabric to be selectively trained and conveyed to travel to and from the fabric supporting means, so that the apparatus is enabled to perform experimental tests on fabrics of varying lengths and even to test differing fabrics in a single shearing operation by sewing lengths of differing fabrics together. A seam detector may be provided to recognize the approach to the treating roller of each fabric seam.

DETAILED DESCRIPTION OF THE PREFERRED EMBODIMENT

Figure 1:
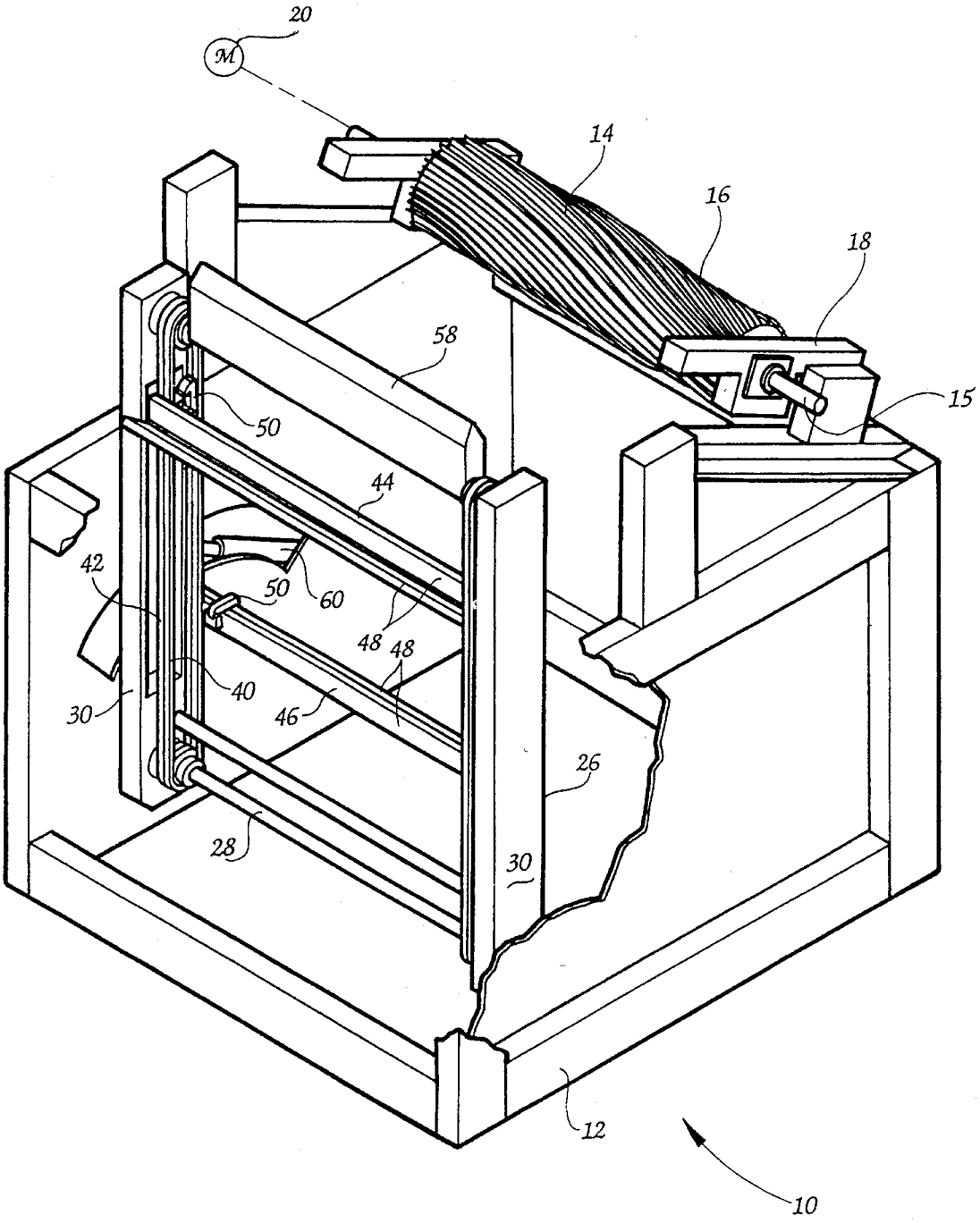
FIG. 1 is a partially schematic perspective view of a textile shearing machine in accordance with one preferred embodiment of the present invention.

Referring now to the accompanying drawings and initially to FIG. 1, a textile fabric shearing machine is shown generally at 10 in accordance with one preferred embodiment of the present invention specifically designed and intended for use in a laboratory or research and development facility for performing experimental shearing operations on sample pieces of textile fabrics.

Figure 3:
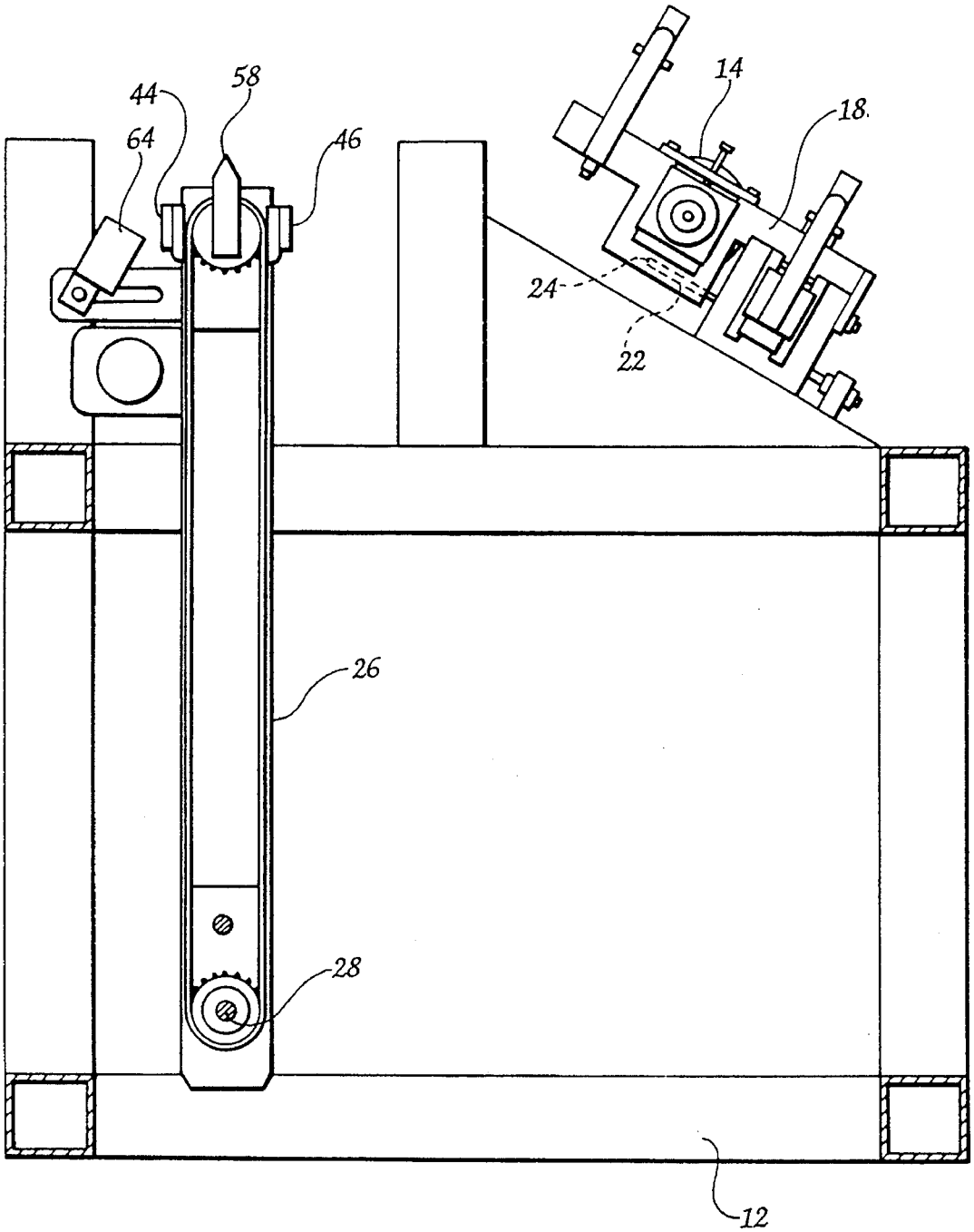
FIG. 3 is a side elevational view of the shearing machine of FIG. 1, with the fabric supporting arm thereof disposed in fabric-loading position.
Figure 4:
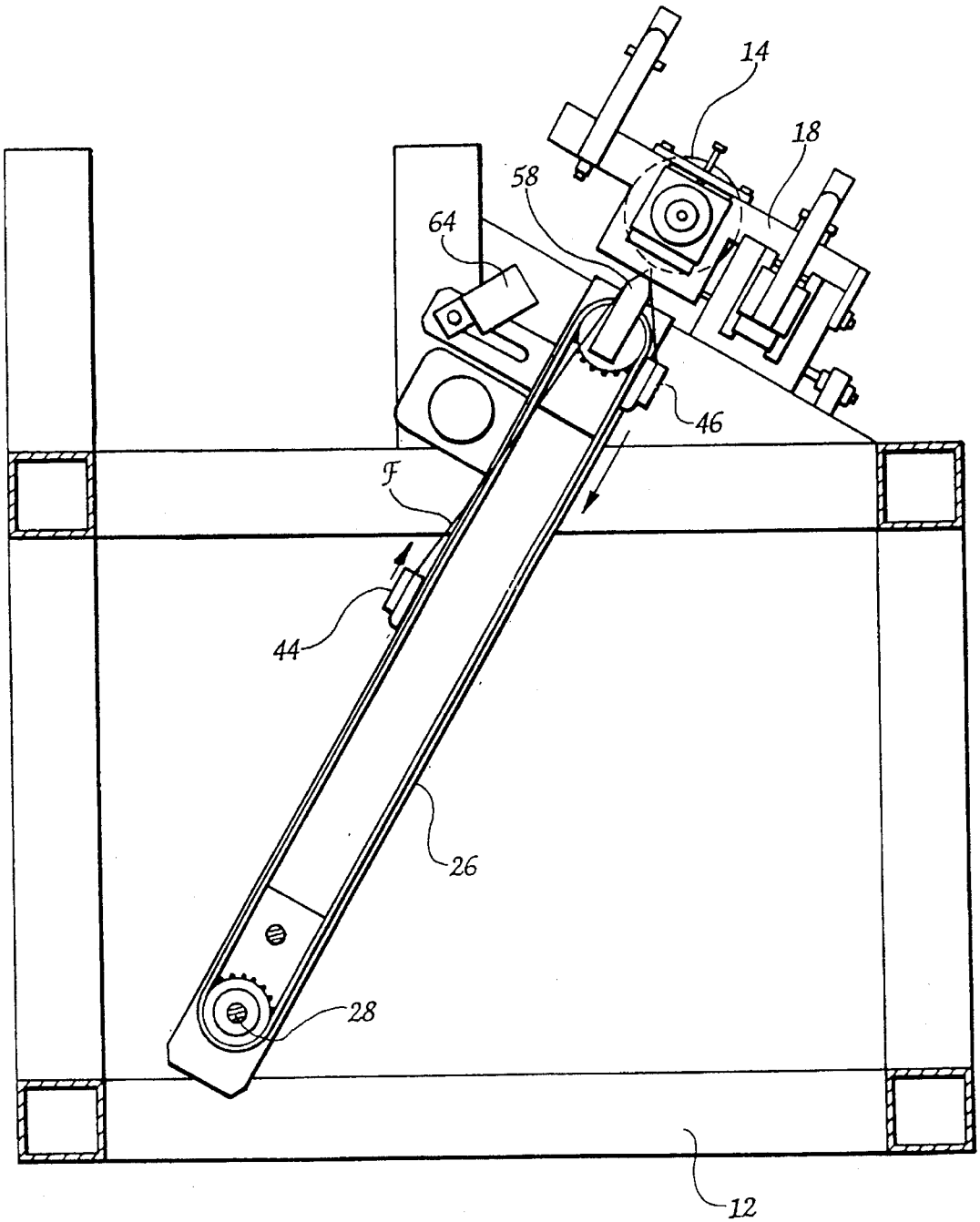
FIG. 4 is another side elevational view of the shearing machine of FIG. 1, with the fabric supporting arm thereof in treatment position at the start of a shearing operation on a relatively short length of fabric.

The shearing machine 10 comprises a rectangular floor-standing frame 12, normally enclosed by top, side and end panels which have been omitted to expose the internal operating components of the machine. A shearing cylinder 14 equipped with a plurality of helically extending shear blades 16 is rotatably supported laterally across the upper rearward side of the frame 12 by a mounting assembly 18 affixed to the frame 12. The shearing cylinder 14 is rotatably driven by a drive motor, shown only representatively at 20, connected to one end of the cylinder shaft 15. The mounting assembly 18 includes a ledger blade 22 (FIGS. 3 and 4)

extending forwardly in close adjacency to the periphery of the shearing cylinder 14 and terminating in a cutting edge 24 extending in axially parallel relation to the cylinder 14 and shear-cutting relation with its blades 16. The mounting assembly 18 includes various mechanisms by which the relative disposition of the cylinder 14 and the ledger blade 22 to one another and to the machine frame 12 can be selectively adjusted, comparable to the adjustment mechanisms provided on conventional commercial production shearing machines.

Figure 2:
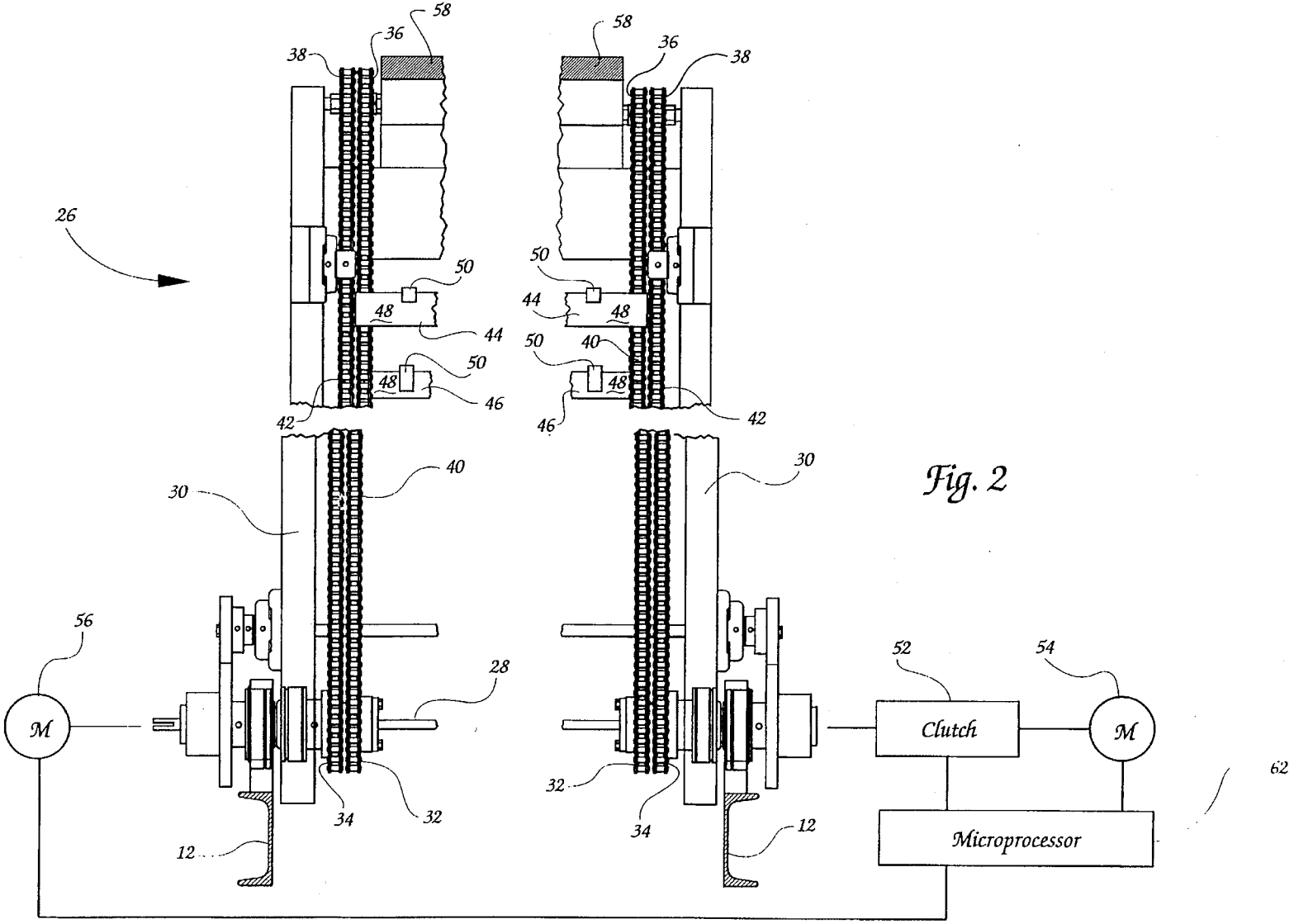
FIG. 2 is a front elevational view of the fabric supporting arm assembly of FIG. 1.

An arm assembly 26 for supporting and conveying a length of textile fabric (not shown in FIG. 1) is pivotably mounted at its lower end to the frame 12 for movement between a fabric loading position (FIG. 3) wherein the arm assembly 26 is in an upstanding disposition spaced forwardly from the shearing cylinder 14 and a shearing disposition (FIG. 4) wherein the arm assembly 26 is inclined rearwardly with its upward end in close adjacency to the shearing cylinder 14. As best seen in FIG. 2, the arm assembly 26 has a supporting pivot shaft 28 mounted to the frame 12 by rotational bearings and a pair of upright arm members 30 affixed to opposite ends of the pivot shaft 28 in spaced parallel facing relation. A pair of toothed sprockets 32,34 are mounted for independent rotation to the lower end of each arm member 30 coaxially with each other and with the pivot shaft 28. Similarly, a pair of sprockets 36,38 are coaxially mounted to the upper end of each arm member 30 for independent rotation. At each opposite side of the arm assembly 26, the respective sprockets 32,36 are aligned in a common vertical plane with an endless timing chain 40 trained in meshing engagement about the respective sprockets 32,36 and, likewise, the respective sprockets 34,38 are aligned in another common vertical plane spaced closely parallel to the first plane with another endless timing chain 42 trained in meshing engagement about the respective sprockets 34,38.

A clamping bar 44 extends transversely between, and is fixed at its opposite ends to, the two chains 40 at the opposite sides of the arm assembly 26. Similarly, another clamping bar 46 extends transversely between, and is rigidly fixed at its opposite ends to, the two chains 42 at the opposite sides of the arm assembly 26. In this manner, the chains 40 together with the connecting clamping bar 44 move integrally with one another about the sprockets 32,36, while the chains 40 with their connecting clamping bar 46 travel integrally about the sprockets 34,38. Each clamping bar 44 includes a pair of clamping members 48 which are pivotably connected to one another for opening and closing movement to receive and then clamp an edge of fabric. A pair of retaining clips 50 are provided at opposite ends of each clamping bar 44 to selectively hold the clamping members 48 in clamping engagement.

At one side of the machine frame 12, the sprockets 32,34 are connected to a clutch, preferably a magnetic particle clutch, shown only representatively at 52, by which the sprockets 32,34 may be selectively coupled or uncoupled so that, in turn, the respectively associated chains 40,42 and clamping bars 44,46 can be selectively coupled for independent or unitary movement with the sprockets. At the same side of the machine, the sprocket 32 is connected through the clutch 52 with a drive motor 54, by which the sprocket 32 and, in turn, its associated chain 40 and sprocket 36, together with the corresponding sprockets 32,36 and chain 40 at the opposite side of the machine, can be driven independently of the sprockets 34,38 and chains 42 when the clutch is disengaged. At the opposite side of the machine, the sprocket 34 is connected to a variable speed drive motor 56 by which the sprocket 34 and its associated chain 42 and sprocket 38, together with the corresponding sprockets 34,38 and chain 42 at the opposite side of the machine, can be selectively driven either independently of or unitarily with the sprockets 32,36 and chains 40 depending upon the condition of the clutch 52.

A tapered fabric nose bar 58 is affixed to and extends laterally between the upper ends of the arm members 30 in parallel relation to the axis of the shear cylinder 14 for deflection over the nose bar 58 of a piece of fabric for shear cutting operation, as more fully explained below.

A linear actuator 60, e.g., a fluid-operated piston-and-cylinder assembly, is mounted at one end to the frame 12 and at the other end to the arm assembly 26 to control pivoting movement of the arm assembly 26 between the fabric-loading position of FIG. 3 and the shear-cutting position of FIG. 4.

A central microprocessor 62 is connected to the drive motors 54,56, the clutch 52, and the linear actuator 60 and is selectively programmed to control their respective operation in the manner hereinafter described.

The normal operation of the machine 10 for shearing a sample piece of textile fabric F may best be understood with reference to FIGS. 3 and 4. The arm assembly 26, particularly the spacing of the sprockets 32,34,36,38 and the length of the chains 40,42, is adapted to accommodate relatively small sample pieces of fabric, e.g., between 12 inches and 32 inches in length and up to 24 inches in width. A suitable piece of fabric F within these dimensional parameters is loaded into the machine 10 by entering an appropriate command into the microprocessor 62 to initiate a programmed fabric-loading sequence wherein, first, the linear actuator 60 is withdrawn to pivot the arm assembly 26 into the upright fabric-loading position of FIG. 3 and, then, the drive motors 54,56 and the clutch 52 are operated to drive the sprockets 32,34,36,38 and the chains 40,42 oppositely to position the respective clamping bars 44,46 at the opposite forward and rearward sides at the upper end of the arm assembly 26, as also shown in FIG. 3.

In this disposition of the arm assembly 26, each clamping bar 44,46 can be opened by a machine operator and the opposite end edges of the fabric piece F inserted and secured into the respective clamping bars 44,46, with the intermediate length of the fabric F extending upwardly over the nose bar 58 with the pile or plush surface of the fabric F facing upwardly. Next, with the clutch 52 deactuated, the drive motor 54 is energized to drive the sprockets 32,36, their respective chains 40, and the associated clamping bar 44 downwardly to tension the fabric F lengthwise over the nose bar 58. Once the fabric F is satisfactorily tensioned in this manner (which can be monitored and signaled to the microprocessor 62 in any appropriate manner), the drive motor 54 is deactuated and the clutch 52 is energized to effectively couple the sprockets 32,34,36,38, the associated chains 40,42, and the associated clamping bars 44,46 for unitary driven operation and the linear actuator 60 is extended to pivot the arm assembly 26 into the fabric shearing disposition of FIG. 4.

Any necessary positional adjusting of the shearing cylinder 14 is carried out and, then, the shearing cylinder motor 20 is energized to drive rotation of the shearing cylinder 14 and the drive motor 56 is also energized to unitarily drive the chains 40,42 in the direction indicated by the arrows in FIG. 4 to cause the fabric F to travel lengthwise over the nose bar 58 for presentation of the pile or plush fabric surface to the nip area between the shearing cylinder blades 16 and the ledger blade 22 for shear-cutting of the fabric surface. Based on the fabric tension sensing arrangement, the microprocessor 62 initially computes and stores the length of the fabric piece during the initial fabric loading sequence and utilizes this stored data to terminate the fabric travel before the clamping bar 44 advances into engagement with the nose bar 58. If desirable, the microprocessor 62 can be commanded to reverse the traveling movement of the fabric to carry out a second shearing pass of the fabric.

Advantageously, by selectively adjusting variable operating parameters of the machine 10, such as the relative spacing and dispositions of the shearing cylinder 14 and the ledger blade 22 and the traveling speed of the fabric, experimentation with differing shearing effects on differing pieces of the same or differing types of fabrics can be easily carried out in a controlled laboratory or research and development setting as a means of determining appropriate settings of commercial production shearing machinery.

Figure 5:
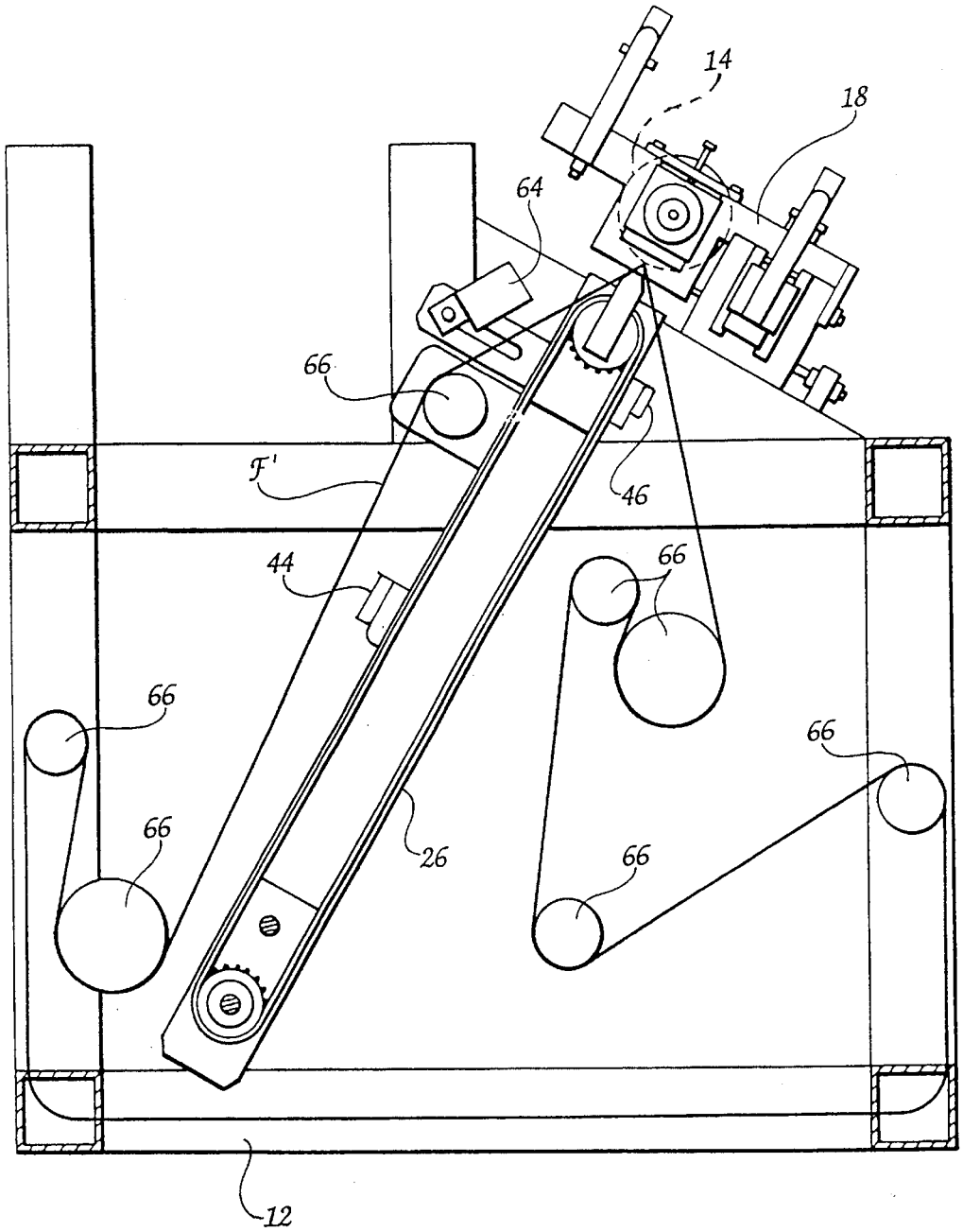
FIG. 5 is another side elevational view of the shearing machine of FIG. 1, showing the machine threaded with, and in shearing operation on, a continuous loop of fabric.
Figure 6:
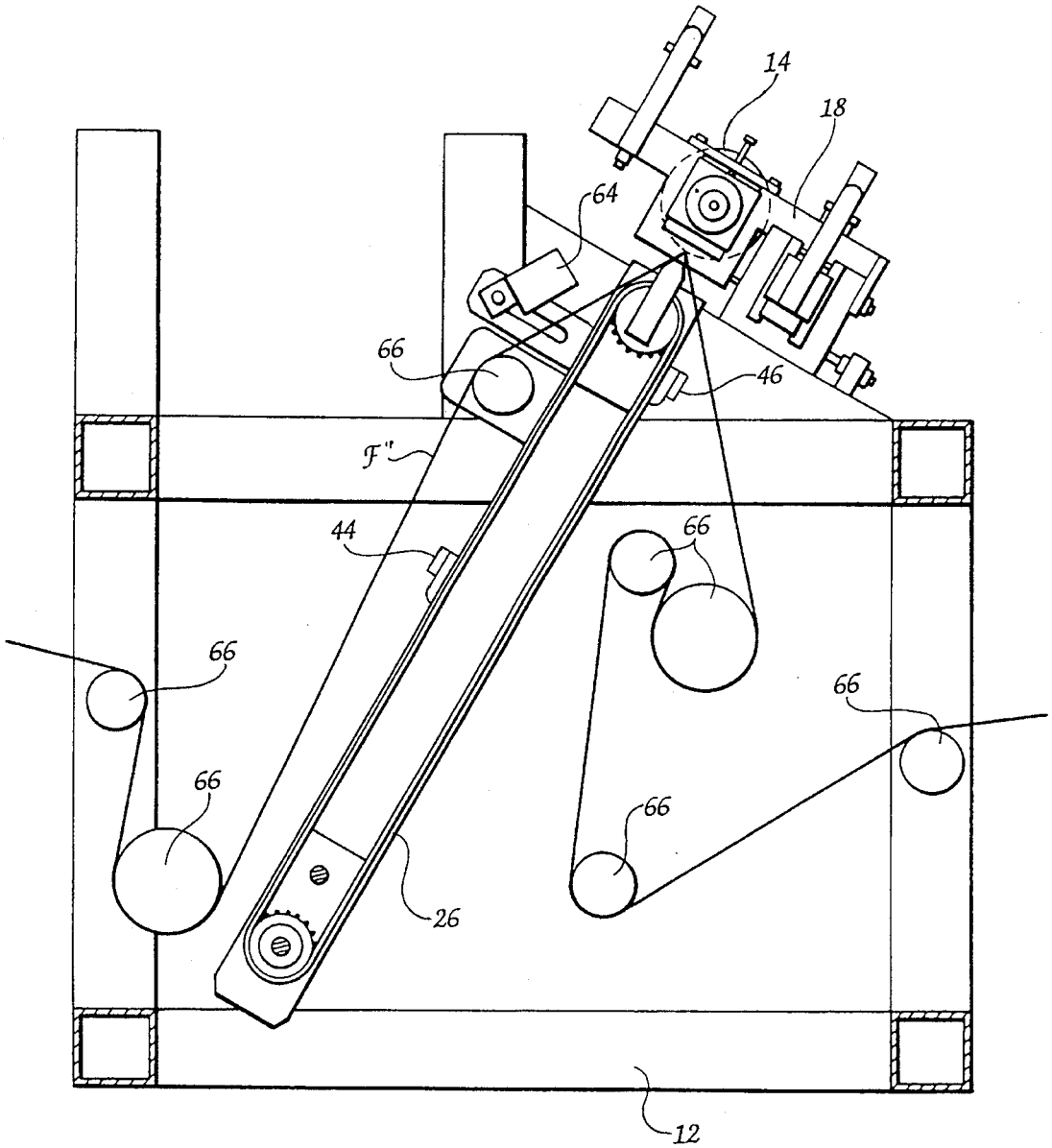
FIG. 6 is another side elevational view of the shearing machine of FIG. 1, showing the machine threaded with, and in shearing operation on, an indeterminate extended length of fabric.

As best seen in FIGS. 5 and 6, the shearing machine 10 is equipped with a number of guide rolls 66 rotatably mounted to the machine frame 12 to extend transversely thereacross, whereby a continuous loop of fabric F' may be selectively loaded into the machine 10 for shear-cutting experiments, as depicted in FIG. 5, or alternatively an extended indeterminate length of fabric F" may be threaded through the machine for shear-cutting experiments, as depicted in FIG. 6. In either case, the fabric loop F' or the length of fabric F" may be comprised of two or more shorter lengths of fabric sewn together at abutting fabric end edges. As will be understood, it may be important in many circumstances that the seam between differing pieces of fabric not be subjected to shear-cutting by the shearing cylinder 14 and, accordingly, the arm assembly 26 is equipped with an electronic seam detector 64 shortly in advance of the nose bar 58 to signal the microprocessor 62 upon the approach of each fabric seam to the nose bar 58, whereby the microprocessor 62 can actuate a momentary adjusting movement of the shearing cylinder mounting assembly 18 away from the nose bar 58 to protect the integrity of the fabric seam. In this manner, more extensive experimentations can be carried out with larger pieces of fabric to better simulate and assess shearing effect in a production setting.

As those persons skilled in the art will readily recognize, the machine 10 of the present invention is not limited to shearing operations. For example, it is contemplated that the machine 10 may be equipped with other forms of fabric surface-treating rolls than the shearing cylinder 14, such as a tigering roll (not shown), and thus it is to be understood that the present invention is not limited to the particular shearing embodiment illustrated and described herein.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for surface treatment of a finite length of pile and plush fabrics, comprising a rotatably driven treating roller having means at a pile-engaging periphery thereof for physical manipulation of a surface of the length of fabric, means for supporting the length of fabric for presentation to the roller for surface treatment, the fabric supporting means being movable between a fabric-loading position spaced from the roller and a treatment position in close adjacency to the roller, the fabric supporting means comprising a pair of fabric clamps, means for moving the clamps selectively toward one another for attachment of opposite ends of the length of fabric respectively to the clamps and away from one another for tensioning the length of fabric, and means for moving the clamps in synchronism with one another to cause the length of fabric to travel in tensioned condition for presentation to the roller for surface treatment.

2. Apparatus for surface treatment of pile and plush fabrics according to claim 1, wherein the means for moving the fabric clamps toward and away from one another comprises a pair of elongate chain means selectively movable in opposite directions, each of the fabric clamps being affixed to a respective one of the chain means.

3. Apparatus for surface treatment of pile and plush fabrics according to claim 2, wherein the means for moving the clamps in synchronism comprises a clutch for operatively connecting and disconnecting the chain means with respect to one another.

4. Apparatus for surface treatment of pile and plush fabrics according to claim 2, wherein the fabric supporting means comprises an arm movable between the fabric-loading and treatment positions, each of the chain means being of an endless configuration and being mounted generally coextensively with one another to the arm.

5. Apparatus for surface treatment of pile and plush fabrics according to claim 4, wherein each of the chain means comprises a pair of essentially identical chains connected with one another in spaced parallel facing relation for integral movement.

6. Apparatus for surface treatment of pile and plush fabrics according to claim 4, wherein the arm assembly is mounted for pivoting movement between the fabric-loading and treatment positions.

7. Apparatus for surface treatment of pile and plush fabrics according to claim 1 and further comprising guide means for selectively training and conveying an endless loop of fabric to travel to and from the fabric supporting means.

8. Apparatus for surface treatment of pile and plush fabrics according to claim 1 and further comprising guide means for selectively training and conveying an extended indeterminate length of fabric to travel to and from the fabric supporting means.

9. Apparatus for surface treatment of pile and plush fabrics according to claim 1, wherein the roller is a fabric shearing roller having a plurality of shear blades spaced about its periphery, the fabric supporting means including a nose bar extending in parallel relation to the axis of the shearing roller for placement of the fabric over the nose bar.

10. Apparatus for surface treatment of pile and plush fabrics according to claim 1, wherein the roller is a tigering roller.

11. Apparatus for surface treatment of a finite length of pile and plush fabrics, comprising a rotatably driven treating roller having a pile-engaging periphery, means for supporting the length of fabric for presentation to the roller for surface treatment, the fabric supporting means comprising an arm movable between a fabric-loading position spaced from the roller and a treatment position in close adjacency to the roller, the fabric supporting means comprising a pair of fabric clamps, means for moving the clamps selectively toward one another for attachment of opposite ends of the length of fabric respectively to the clamps and away from one another for tensioning the length of fabric, and means for moving the clamps in synchronism with one another to cause the length of fabric to travel in tensioned condition for presentation to the roller for surface treatment, the means for moving the fabric clamps toward and away from one another comprising a pair of elongate endless chain means selectively movable in opposite directions, each of the fabric clamps being affixed to a respective one of the chain means and each of the chain means being mounted generally coextensively with one another to the arm.

12. Apparatus for surface treatment of pile and plush fabrics according to claim 11, wherein each of the chain means comprises a pair of essentially identical chains connected with one another in spaced parallel facing relation for integral movement.

13. Apparatus for surface treatment of pile and plush fabrics according to claim 11, wherein the arm assembly is mounted for pivoting movement between the fabric-loading and treatment positions.

* * * * *